United States Patent [19]

Miyoshi et al.

[11] 4,367,720

[45] Jan. 11, 1983

[54] RUN ON PREVENTION SYSTEM SUPPLYING MAXIMUM EXHAUST GAS RECIRCULATION

[75] Inventors: Takeo Miyoshi; Takanori Nagai; Akira Ii, all of Toyota, Japan

[73] Assignee: Toyota Jidosha Kogyo Kabushiki Kaisha, Toyota, Japan

[21] Appl. No.: 215,701

[22] Filed: Dec. 12, 1980

[30] Foreign Application Priority Data

Jul. 29, 1980 [JP] Japan ..... 55-104004

[51] Int. Cl.[3] ..... F02M 25/06; F02D 7/00

[52] U.S. Cl. ..... 123/571; 123/397; 123/DIG. 11

[58] Field of Search ..... 123/571, 568, DIG. 11, 123/397

[56] References Cited

U.S. PATENT DOCUMENTS

| | | | |
|---|---|---|---|
| 3,374,777 | 3/1968 | Walker | 123/DIG. 11 |
| 3,788,288 | 1/1974 | Harrison et al. | 123/328 |
| 4,116,178 | 9/1978 | Saito | 123/568 |

FOREIGN PATENT DOCUMENTS

| | | | |
|---|---|---|---|
| 54-20237 | 2/1979 | Japan | 123/DIG. 11 |

*Primary Examiner*—Wendell E. Burns

*Attorney, Agent, or Firm*—Stevens, Davis, Miller & Mosher

[57] ABSTRACT

An internal combustion engine includes an intake system and an exhaaust system, and an exhaust gas recirculation conduit leads from the exhaust system to the intake system for recirculating exhaust gas. An exhaust gas recirculation control valve at an intermediate part of the exhaust gas recirculation passage controls the flow of exhaust gases therein, and is operated by supply of actuating vacuum. The supply of actuating vacuum to the exhaust gas recirculation control valve is furnished according to engine operational conditions. A vacuum tank accumulates vacuum while the engine is running. A vacuum conduit joins the vacuum tank to the exhaust gas recirculation control valve, and is controlled by a vacuum valve which is closed when the ignition system of the engine is being supplied with electrical power, and is open when the ignition system is not being supplied with electrical power. When the engine is switched off, the vacuum valve opens and supplies vacuum from the vacuum tank to operate the exhaust gas recirculation control valve and to open the exhaust gas recirculation valve to its maximum extent, thus providing maximum exhaust gas recirculation, in order to prevent run on of the internal combustion engine in dieseling fashion.

1 Claim, 2 Drawing Figures

RUN ON PREVENTION SYSTEM SUPPLYING MAXIMUM EXHAUST GAS RECIRCULATION

BACKGROUND OF THE INVENTION

The present invention relates to a run on prevention device for an internal combustion engine, one more particularly relates to a run on prevention device for an internal combustion engine which is provided with an exhaust gas recirculation system.

The problem of so called running on often arises with internal combustion engines. When it is desired no longer to operate such an engine the ignition circuit thereof, in the case of a spark ignition engine, is switched off, so that the engine should thereby stop rotating as soon as the rotational energy has been absorbed by friction. However, sometimes undesirably the engine continues to function in a so called dieseling mode wherein gasoline which is sucked into the combustion chambers in the normal way is ignited, not by any electric spark produced by the spark plugs, since the ignition system has been switched off, but instead by hot spots or the like within the combustion chambers, such as glowing morsels of carbon adhering to the sides thereof, especially around the exhaust ports and exhaust valves of the combustion chambers, which, when the maximum level of compression is attained during the compression stroke of a cylinder, are often able to ignite the fuel-air mixture. Thereby, the internal combustion engine may continue to rotate, since the carburetor thereof will continue to function irrespective of the on/off condition of the ignition circuit thereof.

Such running on is wasteful of fuel, and causes great unpredictability of the behavior of the internal combustion engine. Further, because as a matter of course such hot spot dieseling ignition is irregular, the rotation of the engine is irregular and imperfect, and accordingly a great deal of vibration and noise are produced during the running on condition, and this can be very annoying for the driver of a vehicle incorporating the engine, and for the occupants thereof. Further, because such compression or dieseling ignition, which operates by a mechanism similar to that of so called "pinking", often may well occur at a rather advanced point in the engine rotational timing chart, severe stress is often caused to the various mechanical components of such an engine which runs on, thus shortening their useful operating lives. Yet further, because as has been explained above the running on ignition during running on is imperfect and irregular, and may well only occur on a minority of the compression strokes of any particular combustion chamber, typically running on operation expels a great deal of unburnt fuel such as gasoline into the exhaust manifold of the engine. There is a possibility that this unburnt fuel may explode in the exhaust system, and this can be very troublesome, noisy, and dangerous. Further, the problem of overheating of a catalytic converter fitted to the exhaust system of the internal combustion engine, due to the feeding of large quantities of uncombusted hydrocarbons thereinto, is very serious.

This problem of running on has become more acute in modern automobiles in which measures for reduction of exhaust gas pollution have been incorporated. In such automobiles, typically spark timing is rather retarded, which promotes the accumulation of such carbon and soot deposits as provide good sites for the glowing parts or hot spots within the cylinder chamber which are involved in running on operation. Further, a large amount of valve timing overlap, and provision of exhaust gas recirculation, further contribute to the build up of these deposits. These operational parameters also contribute to hotter running of certain parts of the cylinder chambers of the internal combustion engine, which further encourages the production of these hot spots. Further, even a small amount of running on of an engine greatly increases the emissions of unburnt hydrocarbons in the exhaust gases thereof. Accordingly, in modern automobile engines, it has become necessary to take effective measures against such running on.

Several sorts of run on prevention systems have been previously proposed. A first way of preventing running on of an internal combustion engine has been to provide a fuel cut off mechanism in the carburetor, which interrupts the fuel supply passage within the carburetor in response to turning off of the ignition system of the engine by the ignition key thereof. This system works, but it has its drawbacks. Because within a modern carburetor there are several jets and orifices which supply fuel into the intake tract or throat thereof, since it is impracticable to provide separate fuel cut off mechanisms in all these passages, accordingly a fuel cut off mechanism must be provided at a position some way back in the direction of the flow of liquid fuel from the nozzles within the throat of the carburetor. Accordingly, when the engine is switched off, a certain amount of liquid fuel still remains between the fuel cut off mechanism and the ends of the nozzles within the carburetor throat, and accordingly the effect of this fuel cut off mechanism is not immediately obtained, and a certain amount of running on of the internal combustion engine is still able to occur. Further, the additional complication of the fuel passages within the carburetor may well deteriorate the accuracy of fuel metering by the carburetor, in some operational conditions of the internal combustion engine.

A second system that has been proposed and practiced for preventing running on of an internal combustion engine has been to provide a special air supply valve which, when the engine is switched off, opens so as to provide a large amount of air directly into the intake system of the internal combustion engine, bypassing the carburetor. Thereby, a large amount of excess air is provided to the air-fuel mixture that is being sucked in by the internal combustion engine for dieseling operation, and accordingly it is hoped that dieseling ignition of this very weak air mixture by hot spots and the like will be prevented. However, there are problems with this approach. First, it is quite possible that the internal combustion engine may be able to operate in the over lean mode, and to ignite such over lean air-fuel mixture, in which case this system will be ineffective. Further, the provision of such a relatively large air supply valve, and large diameter air pipes leading to and from it, is troublesome and expensive, and is inconvenient for design of the intake system of the internal combustion engine, and for location thereof within the engine compartment. Further, problems arise such as possible changes in the air/fuel ratio when the internal combustion engine is operating in the normal operational mode, due to possible leakage of such an air supply valve, which, even in a small amount, can greatly deteriorate the operability of the engine. Yet further, due to the fact that the air intake system of an engine including such an air supply valve is of large diameter and accordingly of a very low air flow resistance, difficulties arise with regard to the restartability of the engine, especially from the cold condition.

Accordingly, as yet no fully suitable and operable run on prevention system for an internal combustion engine has been proposed.

In modern engines, as mentioned above, the problem of reducing the amount of noxious pollutants in the exhaust gases is severe. One of the conventional solutions for reduction of the level of pollutants in exhaust gases is to provide exhaust gas recirculation for the internal combustion engine, wherein an exhaust gas recirculation conduit is provided which connects a part of the exhaust system of the engine to a part of the intake manifold thereof after the carburetor, so that a certain amount of the exhaust gases which are being blown out through the exhaust system is instead taken into this exhaust gas recirculation passage, and is recycled into the inlet manifold. Within the exhaust gas recirculation passage there is typically provided an exhaust gas recirculation control valve, and this again typically is controlled by supply of actuating vacuum thereto, and in response to such supply of actuating vacuum opens and closes a valve port by a valve element, so as to vary the effective flow resistance of the exhaust gas recirculation conduit and so as to provide a proper amount of exhaust gas recirculation according to the current operational conditions of the internal combustion engine. Further, in certain systems, it is well known and conventional for the actuating vacuum which actuates this exhaust gas recirculation control valve to be provided from a vacuum take off port situated within the throat of the carburetor at a position which is upstream of a butterfly throttle valve thereof when the throttle valve is fully closed, but which is downstream of said throttle valve when said throttle valve is opened by more than a certain predetermined small amount.

Such an exhaust gas recirculation control system has been found effective in practice for reducing the amount of undesirable noxious pollutants in the exhaust gases of an internal combustion engine. Further, as a refinement thereof, it has been practiced to provide a pressure plenum within the exhaust gas recirculation passage, just upstream of the valve port and the valve element of the exhaust gas recirculation control valve, the pressure within which controls a vacuum adjustment valve which modifies said vacuum produced by said vacuum take out port within the throat of the carburetor in such a way that the exhaust gas recirculation control valve is controlled in its opening and closing amount in such a way as to maintain the pressure within said pressure plenum effectively constant. This ensures that the amount of exhaust gas which is recirculated to the exhaust gas recirculation passage is proportional to, i.e., is linearly dependent upon, the total amount of the gases which are being inhaled by the internal combustion engine through the inlet manifold thereof. In other words, such an arrangement ensures a substantially constant exhaust gas recirculation ratio, substantially irrespective of the opening of the intake throttle valve of the internal combustion engine, and of the revolution speed thereof.

SUMMARY OF THE INVENTION

It has occurred to the inventors of the present invention that it would be a good idea to combine such an exhaust gas recirculation system, as outlined above, with a run on prevention system, and that this might result in a simple and operable device with few additional parts.

Accordingly, an object of the present invention is to provide a simple and effective run on prevention system, which causes no bad effects on the internal combustion engine with regard to operability, accuracy of fuel management, restartability, or design difficulties; and which eliminates the aforesaid problems with the prior art, such as changes in air/fuel ratio due to leakage of an air supply valve, and which is cheap to manufacture and reliable during use.

A further object of the present invention is to provide such a run on prevention device as outlined above, which is effectively combined with such an exhaust gas recirculation system as also outlined above, in order to provide several functions from the same parts of the internal combustion engine, thus simplifying the design thereof, and reducing its cost.

A further object of the present invention is effectively to prevent running on of an internal combustion engine, and thereby to minimize undue stress upon the various structural elements thereof caused by such running on, and to eliminate unpleasant noise and vibration associated therewith.

A yet further object of the present invention is to protect a catalytic converter mounted on the exhaust system of an internal combustion engine from unduly large supply of unburnt hydrocarbons thereto, due to running on operation of the internal combustion engine.

A yet further object of the present invention is to eliminate the danger of ignition of an accumulation of liquid fuel in the exhaust manifold of an internal combustion engine, said accumulation of liquid fuel being caused by irregular and imperfect dieseling running on operation.

According to the present invention, these objects, and others, are accomplished by, for an internal combustion engine comprising: an ignition system; an intake system; an exhaust system; an exhaust gas recirculation conduit, one end of which is connected to said exhaust system, and the other end of which is connected to said intake system; and an exhaust gas recirculation control valve, located in an intermediate portion of said exhaust gas recirculation conduit, operated by supply of actuating vacuum thereto, and controlling the opening and closing of said exhaust gas recirculation conduit according to said supply of actuating vacuum, supply of high actuating vacuum fully opening said exhaust gas recirculation control valve and providing exhaust gas recirculation to the maximum amount; said supply of actuating vacuum to said exhaust gas recirculation control valve being performed according to the operational condition of said internal combustion engine: a run on prevention system, comprising: (a) a vacuum tank which accumulates vacuum while said internal combustion engine is running; (b) a vacuum conduit, which joins said vacuum tank to said exhaust gas recirculation control valve; and (c) a vacuum valve which controls fluid flow through said vacuum conduit, and which is open when said ignition system is not supplied with actuating electrical power, and is closed when said ignition system is supplied with actuating electrical power; whereby, when said ignition system is first turned off in order to stop the operation of said internal combustion engine, said vacuum valve opens from the closed condition and supplies a high value of vacuum from said vacuum tank to said exhaust gas recirculation control valve, and thus opens said exhaust gas recirculation control valve to its fullest open extent, thus providing a maximum amount of exhaust gas recirculation and thereby effectively and positively preventing the occurrence of dieseling and run on in said internal combustion engine.

According to such a construction, because the vacuum valve is opened when the ignition system of the vehicle incorporating the engine is switched off, at this time said vacuum valve connects said vacuum tank via said vacuum conduit to said exhaust gas recirculation control valve, and accordingly provides a maximum amount of vacuum for operating said exhaust gas recirculation control valve, which accordingly causes said exhaust gas recirculation valve to be fully opened and to provide the maximum amount of exhaust gas recirculation between said exhaust system and said intake system of said internal combustion engine. This is very effective for preventing running on or dieseling operation of the internal combustion engine. Further, this run on prevention system according to the present invention does not involve any large air supply valve such as incorporated in the abovementioned prior art, nor any large air passages leading thereto. Accordingly, the disadvantages of such a prior art with regard to valve leakage, inconvenience of design, and large dimensions of the air valve and associated passages, are eliminated. Further, the present invention has dispensed with any such device as a fuel cut off mechanism in the carburetor, said mechanism being prone to the abovementioned disadvantages. Accordingly, it is seen that the present invention provides a very simple run on prevention device, which merely comprises a simple vacuum valve, which preferably is electrically operated, and a vacuum tank and associated conduits, and which is accordingly cheap and easy to manufacture, and very reliable during use. This has been accomplished by combining the run on prevention device with an exhaust gas recirculation system, in an effective and convenient fashion.

According to a particular aspect of the present invention, the vacuum valve, in the run on prevention system described above, may comprise: a solenoid which is supplied with electric power when said ignition system is supplied with electric power, and is not supplied with electric power when said ignition system is not supplied with electric power; a solenoid core which is magnetically acted upon by said solenoid; a compression coil spring which biases said solenoid core in a first direction; a valve element, connected to said solenoid core, which can move between an extreme position in said first direction and an extreme position in a second direction opposite to said first direction; a plenum chamber within which said valve element is located; an output port opening from said plenum chamber and communicated to said exhaust gas recirculation control valve; a first port opening to said plenum chamber, against which said valve element abuts so as to close it, when said valve element is in its said extreme position in said first direction, and to which is supplied said supply of actuating vacuum for said exhaust gas recirculation control valves; and a second port opening to said plenum chamber, which is communicated to said vacuum tank, and against which said valve element abuts so as to close it, when said valve element is in its extreme position in said second direction.

According to such a structure, when said ignition system is supplied with electrical power, said solenoid attracts said solenoid core against the compression action of said compression coil spring so as to move said valve element in said second direction and so as to close said second port and interrupt supply of vaccum from said vacuum tank to said exhaust gas recirculation control valve, while it opens said first port so as to permit supply of said actuating vacuum to said exhaust gas recirculation control valve; while, when said ignition system is not supplied with actuating electrical energy, said solenoid releases its magnetic attraction on said solenoid core so as to permit said compression coil spring to bias said solenoid core and said valve element to said extreme position in said first direction, so that said valve element closes said first port so as to interrupt supply of said actuating vacuum to said exhaust gas recirculation control valve while it opens said second port so as to provide supply of vacuum from said vacuum tank to said exhaust gas recirculation control valve so as to open said exhaust gas recirculation control valve to its maximum opening amount and thus so as to provide maximum exhaust gas recirculation for said internal combustion engine. Thus, by this simple construction, the present invention positively ensures that the engine is prevented from dieseling operation and running on.

BRIEF DESCRIPTION OF THE DRAWINGS

The present invention will now be shown and described with reference to a preferred embodiment thereof, and with reference to the illustrative drawings. It should be clearly understood, however, that the description of the embodiment, and the drawings, are all of them given purely for the purposes of explanation and exemplification only, and are none of them intended to be limitative of the scope of the present invention in any way, since the scope of the present invention is to be defined solely by the legitimate and proper scope of the appended claims. In the drawings:

DESCRIPTION OF THE PREFERRED EMBODIMENT

Figure 1:
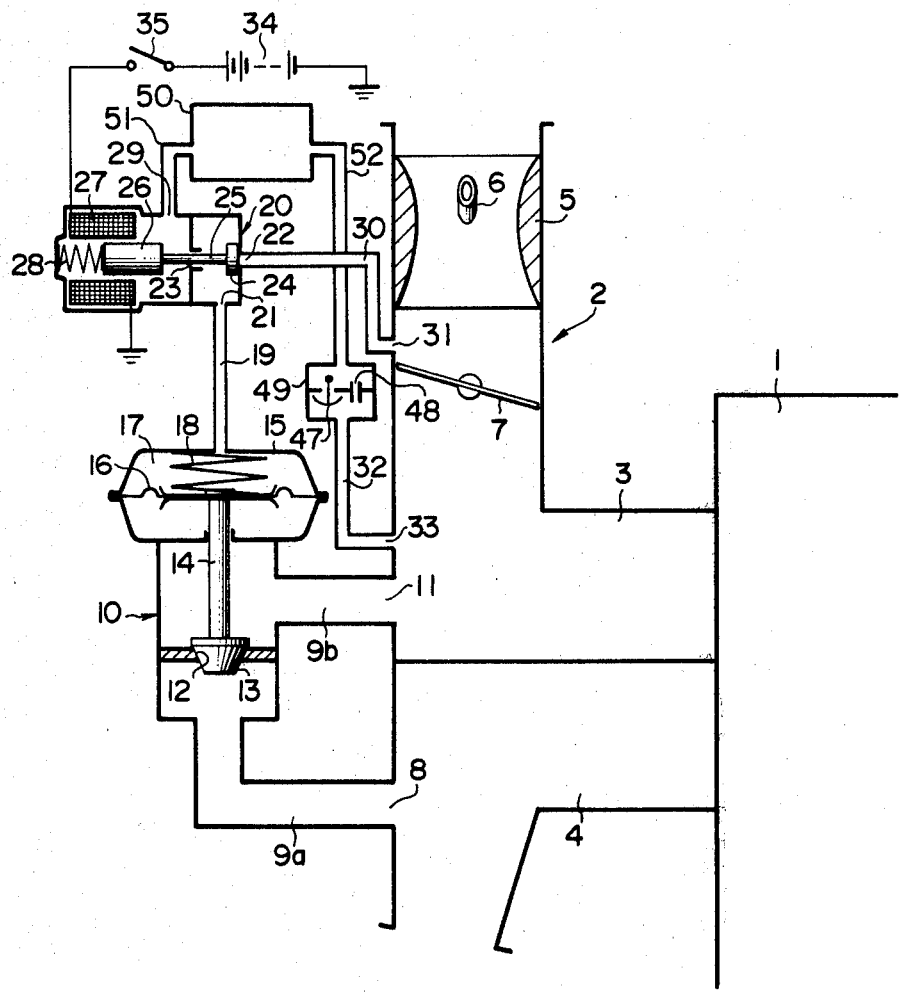
FIG. 1 is a simplified structural diagram, part cross sectional and part block diagrammatical, showing a preferred embodiment of the run on prevention device according to the present invention, as fitted to an internal combustion engine which incorporates a first type of exhaust gas recirculation system equipped with an exhaust gas recirculation control valve.

In FIG. 1, a preferred embodiment of the run on prevention system according to the present invention is shown in partial cross section. An internal combustion engine 1, which is a spark ignition gasoline internal combustion engine, inhales fuel-air mixture from a carburetor 2 through an inlet manifold 3, combusts this fuel-air mixture, and exhausts exhaust gases through an exhaust manifold 4. The engine 1, the carburetor 2, the inlet manifold 3, and exhaust manifold 4 are only shown in schematic cross section in FIG. 1, because the details of their construction are not relevant to the present invention. The carburetor 2 includes a venturi 5 within which there is provided a fuel nozzle 6, and downstream of the venturi 5 and of the fuel nozzle 6 there is provided an intake throttle valve 7, which in this particular carburetor is a butterfly valve.

An exhaust gas recirculation conduit composed of first and second conduit portions 9*a* and 9*b* is provided for recirculating exhaust gas from the exhaust manifold 4 to the inlet manifold 3. In more detail, within the exhaust manifold 4 there is provided an exhaust gas take out port 8, and at an intermediate part of the inlet manifold 3, downstream of the intake throttle valve 7, there is provided an exhaust gas injection port 11. One end of the first exhaust gas recirculation conduit portion 9*a* is connected to the exhaust gas take out port 8, and one end of the second exhaust gas recirculation conduit portion 9*b* is connected to the exhaust gas injection port 11. The other ends of these conduit portions 9*a* and 9*b* are connected to an exhaust gas recirculation control valve 10.

Within the exhaust gas recirculation control valve 10 there is provided a valve port 12, the effective opening cross sectional area of which is controlled by a valve element 13 which is mounted at the end of a valve rod 14 which is slidable upwards and downwards in FIG. 1 with respect to the body of the exhaust gas recirculation control valve 10, so as to be moved towards and away from the valve port 12. According to this motion of the valve rod 14 and the valve element 13 mounted thereon, therefore, the effective cross sectional opening area of the exhaust gas recirculation control valve is varied, so as to provide more or less exhaust gas recirculation through the exhaust gas recirculation conduit composed of the conduit portions 9*a* and 9*b*.

The movement of the valve element 13 and the valve rod 14 is controlled by a diaphragm device 15. The diaphragm device 15 comprises a diaphragm 16, which is biased downwards in the drawing by a compression coil spring 18 which is mounted within a diaphragm chamber 17 defined on the upper side of said diaphragm 16 in FIG. 1. Accordingly, if vacuum less than a certain predetermined vacuum value is supplied to said diaphragm chamber 17 of said diaphragm device 15, then said diaphragm 16 remains in its downwardly biased position as shown in the drawing, and the valve rod 14, which is connected to said diaphragm 16, therefore positively holds said valve element 13 against said valve port 12, so as fully to close the exhaust gas recirculation control valve 10 and so as to provide no exhaust gas recirculation through the first and second exhaust gas recirculation conduit portions 9*a* and 9*b*. On the other hand, if a vacuum value greater than said predetermined vacuum value is supplied to the diaphragm chamber 17 of the diaphragm device 15, then the resistance force of the compression coil spring 18 is overcome by the upward acting force on the diaphragm 16 produced by the effect of said vacuum in the diaphragm chamber 17, and according to this the valve rod 14 and valve element 13 are moved upwards in the drawing away from the valve port 12, and accordingly the exhaust gas recirculation control valve 10 is opened and provides exhaust gas recirculation through the first and second exhaust gas recirculation conduit portions 9*a* and 9*b*, in an amount corresponding to the amount of movement of said valve rod 14 and said valve element 13, i.e., in an amount corresponding to the vacuum value of the actuating vacuum supplied to the diaphragm chamber 17 of the diaphragm device 15. The aforesaid actuating vacuum is supplied to the diaphragm chamber 17 of the diaphragm device 15, according to various engine operational conditions, in order to provide a proper amount of exhaust gas recirculation through the exhaust gas recirculation conduit passage portions 9*a* and 9*b*. It should be noted that, according to the present invention, if a high value of actuating vacuum is supplied to the diaphragm chamber 17 of the diaphragm device 15, then the valve element 13 and the valve rod 14 are lifted in the upwards direction to the maximum extent in FIG. 1, and the valve element 13 is fully withdrawn away from the valve port 12, and in this condition the exhaust gas recirculation control valve 10 is fully open and provides a maximum amount of exhaust gas recirculation through said first and second exhaust gas recirculation conduit portions 9*a* and 9*b*.

The diaphragm chamber 17 of the diaphragm device 15 is connected, via a first vacuum passage 19, to an output port 21 of a vacuum switching valve 20. Within this vacuum switching valve 20, which as will be seen later is electrically operated, there is provided a valve element 24 mounted on the end of a valve rod 25 which can be slid to and fro, leftwards and rightwards in FIG. 1. When the valve element 24 and the valve rod 25 are in their rightwardly biased positions, as shown in the figure, then the output port 21 of the vacuum switching valve 20 is communicated, via an intermediate control port 23 which is opened by the valve element 24 being moved away from it, with a second input port 29. On the other hand, when the valve rod 25 and the valve element 20 are in their leftwardly biased positions, opposite from those shown in the figure, then the valve element 24 presses against the intermediate control port 23, thus blocking it, while at the same time the valve element 24 is removed from a first input port 22 of the vacuum switching valve 20, thus communicating said first input port 22 with said output port 21.

The left hand end in the drawing of the valve rod 25 is connected to a solenoid core 26, which is biased in the rightwards direction in the drawing by a compression coil spring 28, and around the solenoid core 26 and the compression coil spring 28 there is mounted a solenoid 27. Accordingly, when actuating electrical energy is not supplied to said solenoid 27, then the biasing action of the compression coil spring 28 biases said solenoid plunger 26, said valve rod 25, and said valve element 24 in the rightward direction, as seen in the drawing, so as to communicate said second input port 29 and said output port 21, via said intermediate control port 23; while, on the other hand, when said solenoid 27 is provided with actuating electrical energy, then it attracts the solenoid plunger 26 leftwards in the drawing, against the biasing action of the compression coil spring 28 which is overcome, and accordingly the valve element 24 is biased away from said first input port 22 and against said intermediate control port 23, so as to communicate said first input port 22 with said output port 21, and so as to block said intermediate control port 23.

Actuating electrical energy is selectively supplied to the solenoid 27 of the vacuum switching valve 20 from the battery 34 of the vehicle to which this system is provided, via the ignition switch 35 thereof. The first input port 22 of the vacuum switching valve 20 is connected, via a second vacuum passage 30, with a first vacuum take out port 31 which is provided within the throat of the carburetor 2, at a position which is upstream of said intake throttle valve 7 when said intake throttle valve 7 is fully closed, but which is downstream of said intake throttle valve 7 when said intake throttle valve 7 is opened to an opening which is greater than a certain predetermined small opening.

The second vacuum input port 29 of the vacuum switching valve 20 is connected via a vacuum conduit 51 to a vacuum accumulator tank 50, which is connected via a vacuum conduit 52 and a vacuum delay valve 49 and via a vacuum conduit 32 to a second vacuum take out port 33 provided within the inlet manifold at a position which is downstream of the intake throttle valve 7 at all times. The vacuum delay valve 49 is provided within its body, in parallel, with a one way air valve 47 and a throttling element 48. The one way air valve 47 is arranged, as may be seen from the figure, so that it freely allows air to pass from the vacuum accumulator tank 50 through the vacuum conduit 52 to the vacuum conduit 32 to be vented from the second vacuum take out port 33, but so that it prevents flow of air in the reverse direction.

The operation of the exhaust gas recirculation system shown, incorporating the first embodiment of the run on prevention system according to the present invention, is as follows. When the ignition switch 35 is closed, and the internal combustion engine 1 is being provided with power to its ignition system, and is operating, at this time power is being supplied to the solenoid 27 of the vacuum switching valve 20, and in this condition, as already explained, the intermediate port 23 thereof is closed by the valve element 24 which is biased leftwards in the drawing thereagainst, while the first input port 22 of the vacuum switching valve 20 is communicated to the output port 21 thereof. In this condition, in a per se well known mode of providing exhaust gas recirculation control, the vacuum appearing at the first vacuum take out port 31 located within the carburetor 2, which is, as has been mentioned before, upstream of the intake throttle valve 7 when the intake throttle valve 7 is closed, but comes to be downstream of the intake throttle valve 7 when said intake throttle valve 7 is opened by more than a predetermined small amount, is transmitted via the second vacuum passage 30, the vacuum switching valve 20, and the first vacuum passage 19 to the diaphragm chamber 17 of the diaphragm device 15, so as to actuate the exhaust gas recirculation control valve 10, and so as to control the amount of exhaust gas recirculation provided through the exhaust gas recirculation conduit comprising the first and second conduit portions 9*a* and 9*b*, according to certain engine operational conditions, i.e., in this case, according to the amount of opening of the intake throttle valve 7. This form of exhaust gas recirculation control is per se well known in the art. Meanwhile, at this time of engine operation, as a matter of course the intake vacuum present at the second vacuum take out port 33, which is always downstream of said ignition throttle valve 7, is transmitted via the vacuum delay valve 49 (which, owing to the provision of the one way valve 47, offers no substantial obstruction to the transmission of said vacuum), and via the vacuum conduit 52 to the vacuum accumulator tank 50, which thereby becomes exhausted of air, i.e. evacuated. However, this vacuum is not transmitted further from the vacuum accumulator tank 50 than the intermediate port 23 of the vacuum switching valve 20, because said intermediate port 23 is at this time closed by the valve element 24.

Now, when the ignition switch 35 of the vehicle is opened in order to stop the operation of the internal combustion engine 1 by stopping supply of actuating electrical energy to its ignition system, at this time the run on prevention system according to the preferred embodiment of the present invention shown and described above is deployed in the following way. As soon as the ignition switch 35 is switched off, the solenoid 27 ceases to act upon the solenoid core 26, and therefore the compression coil spring 28 biases said solenoid core 26, the valve rod 25, and the valve element 24 rightwards to their positions as shown in FIG. 1, where the valve element 24 blocks the first input port 22 of the vacuum switching valve 20 and opens the intermediate port 23. In this condition, the vacuum from the first vacuum take out port 31 is no longer communicated to the diaphragm chamber 17 of the diaphragm device 15, but, on the other hand, the vacuum present within the vacuum accumulator tank 50 is directly communicated to this diaphragm chamber 17, via the vacuum conduit 51, the second input port 29 of the vacuum switching valve 20, the intermediate port 23 thereof, the output port 21 thereof, and the first vacuum passage 19. The vacuum within the vacuum accumulator tank 50 is at a fairly high level at this time. Accordingly, the diaphragm chamber 17 of the diaphragm device 15 is supplied with a fairly high level of actuating vacuum, and accordingly the diaphragm 16 is attracted upwards strongly in the drawing, against the biasing action of the compression coil spring 18 which is overcome, and accordingly the valve rod 14 and the valve element 13 mounted at the lower end thereof are fully withdrawn from the valve port 12 of the exhaust gas recirculation control valve 10, thereby opening said exhaust gas recirculation control valve 10 to its maximum extent, so that maximum exhaust gas recirculation is provided through the exhaust gas recirculation conduit comprising the first and second exhaust gas recirculation conduit portions 9*a* and 9*b*. This occurs immediately, as soon as the internal combustion engine 1 has been switched off via the ignition switch 35, even before its rotation has ceased. If at this time there is a tendency for engine run on to occur, due to the aforesaid dieseling because of hot spots or the like within the combustion chambers of the internal combustion engine 1, the gases within the exhaust manifold 4, which are chiefly exhaust gases, are recirculated in a large amount to the inlet manifold 3 of the internal combustion engine 1, and the mixture supplied to this internal combustion engine 1, therefore, is either exhaust gas or at any rate is far too weak, i.e., deficient in gasoline, to be ignited. Thereby, this dieseling does not occur, and the internal combustion engine 1 stops substantially immediately, as soon as the rotational energy of the rotating parts thereof has been dissipated by friction. In short, run on is substantially prevented.

When the internal combustion engine 1 has stopped rotating, the vacuum within the inlet manifold 3 thereof quickly disappears. At this time, the vacuum within the vacuum accumulator tank 50 leaks to the inlet manifold 3, progressively, through the throttling element 48. After a certain relatively short time, all of this vacuum disappears, so that the vacuum accumulator tank 50 is at substantially atmospheric pressure, along with the diaphragm chamber 17 of the diaphragm device 15, and thereby the valve element 13 and the valve rod 14 are biased downwards by the compression coil spring 18 of the diaphragm device 15, so as to close the valve port 12 of the exhaust gas recirculation control valve 10, so that in this state the internal combustion engine 1 may again be readily restarted, because, when said internal combustion engine 1 is cranked so as to start it, no gas flow can occur through the exhaust gas recirculation conduit comprising the first and second conduit portions 9*a* and 9*b*.

According to the present invention, the exhaust gas recirculation valve 10 should be made with a relatively large valve port 12, and correspondingly, the first and second exhaust gas recirculation conduit portions 9*a* and 9*b* should be made relatively large, so that it is possible to supply a relatively large quantity of recirculated exhaust gas, when the internal combustion engine 1 is switched off by the ignition switch 35, as explained above, in order effectively to prevent run on of the internal combustion engine 1. However, as compared to the above described prior art run on prevention system, wherein air is supplied into the intake manifold in order to prevent run-off the internal combustion engine, the amount of exhaust gas required to be supplied into the inlet manifold, via the exhaust gas recirculation passage and exhaust gas recirculation control valve 10, is substantially smaller, because of the better effectivness of recirculated exhaust gases for prevention of dieseling.

Figure 2:
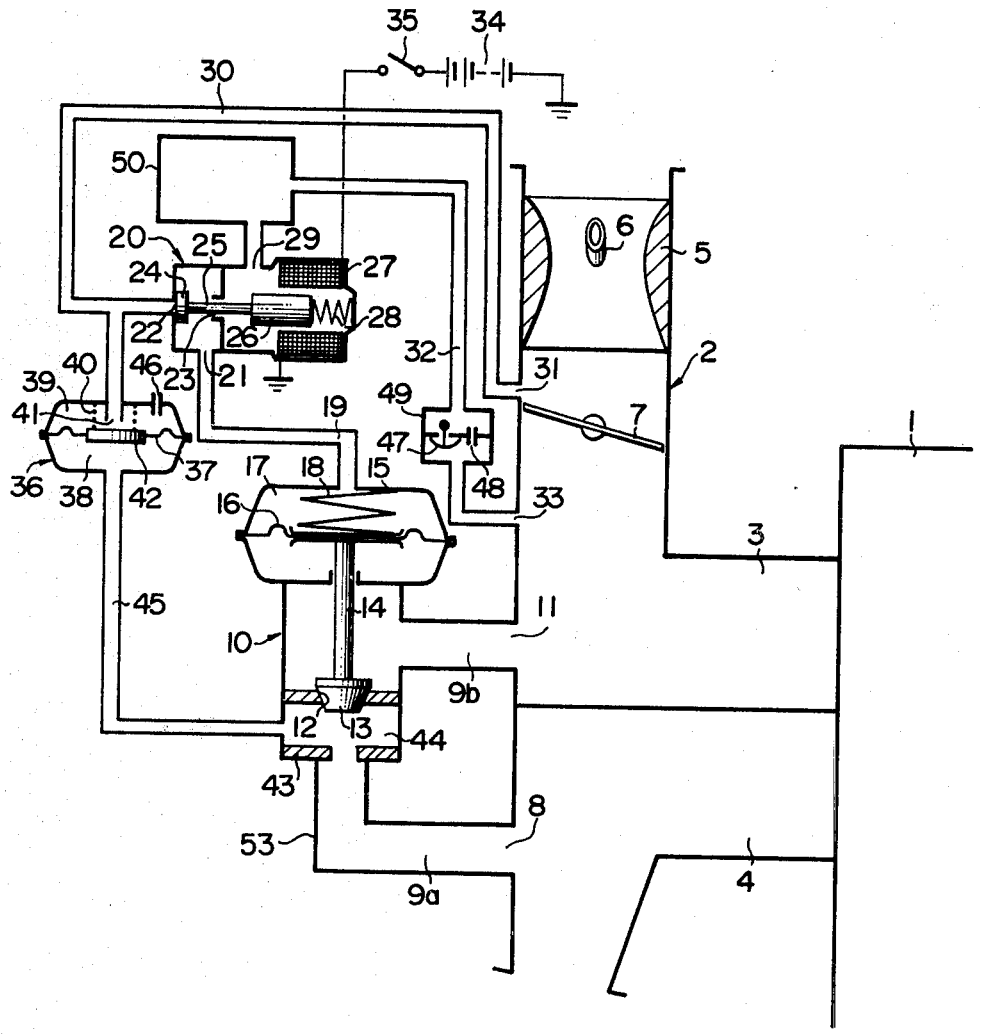
FIG. 2 is a simplified structural view, similar to FIG. 1, showing said preferred embodiment of the run on prevention system according to the present invention, in part sectional part block diagrammatic view, as fitted to an internal combustion engine provided with an exhaust gas recirculation system and an exhaust gas recirculation control valve of another sort, which incorporates a vacuum adjustment valve for maintaining a constant pressure of exhaust gases just upstream of said exhaust gas recirculation control valve, which is incorporated in an exhaust gas recirculation conduit.

FIG. 2 shows the preferred embodiment of the run on prevention system according to the present invention, as applied to a second form of exhaust gas recirculation system. In this figure, parts which correspond to like parts in the application of the preferred embodiment of the present invention shown in FIG. 1, and which have the same functions, are designated by the same reference numerals as in that figure.

In FIG. 2, the run on prevention system according to the present invention is constructed in the same way as in FIG. 1. However, in the exhaust gas recirculation system to which it is fitted, within the exhaust gas recirculation control valve 10 upstream of the valve port 12 thereof, i.e., in the direction of the exhaust manifold 4, there is formed a pressure plenum 44, which is defined between the member within which said valve port 12 is formed and an orifice element 43 with an orifice 53 formed therein, said orifice being communicated to the first exhaust gas recirculation conduit portion 9*a*.

A pressure conduit 45 leads from this pressure plenum 44 to a vacuum adjustment valve 36, and opens into a first chamber 38 thereof, below a diaphragm 37 in the figure. No outlet is provided to this chamber 38 of the vacuum adjustment valve 36, and accordingly the gases within this chamber 38 are at substantially the same pressure as are the gases in the pressure plenum 44. Above the diaphragm 37 of the vacuum adjustment valve 36 there is defined a second chamber 39 therein, which is vented to the atmosphere through an atmosphere vent port 46, and into which there opens a control port 41 which projects somewhat into said second chamber 39. Opposing the control port 41, mounted on the diaphragm 37 of the vacuum adjustment valve 36, there is provided a valve element 42, and within the second chamber 39 there is provided a compression coil spring 40 which biases said valve element 42 and said diaphragm 37 downwards in the drawing. The control port 41 is connected to the vacuum conduit 30, which as in the first construction shown in FIG. 1 leads from the first vacuum take out port 31 provided within the carburetor 2 at a position which is upstream of the intake throttle valve 7 when intake throttle valve 7 is closed, and which is downstream of the intake throttle valve 7 when the intake throttle valve 7 is opened by more than a certain predetermined small amount; said vacuum conduit 30 leading to the first input port 22 of the vacuum switching valve 20. When the pressure in the first chamber 38 of the vacuum adjustment valve 36 is greater than the pressure in the second chamber 39 by more than a certain predetermined amount, then the force of the compression coil spring 40 is overcome, and the diaphragm 37 and the valve element 42 attached thereto are moved upwards in the Figure, so that said valve element 42 closes the control port 41, thereby decreasing the vacuum in the chamber 38 (or increasing the pressure in the chamber 38); while, on the other hand, when the pressure in the first chamber 38 is not greater than the pressure in the second chamber 39 by more than the certain predetermined amount, then the compression coil spring 40 biases the diaphragm 37 and the valve element 42 attached thereto downwards, as shown in the Figure, so that said valve element 42 opens the control port 41, thereby increasing the vacuum in the chamber 39 (or decreasing the pressure in the chamber 39). In a fashion which is per se well known in the art, the system comprising the vacuum adjustment valve 36 and the pressure plenum 44 functions so as to keep the exhaust gas pressure within the pressure plenum 44 always substantially constant near atmospheric pressure. In this way, the rate of recirculation of exhaust gases through the exhaust gas recirculation system is kept linear with regard to the rate at which air is sucked in by the internal combustion engine 1 through the inlet manifold 3; i.e., the exhaust gas recirculation ratio is kept constant.

In this embodiment, as in the previous embodiment, the operation of the run on prevention system according to the present invention is available. That is to say, when the ignition switch 35 is opened in order to switch off the internal combustion engine 1 and to stop it running, at this time the solenoid 27 releases the solenoid core 26, and the compression coil spring 28 biases the valve rod 25 and the valve element 24 leftwards in the drawing, so that the second input port 29 of the vacuum switching valve 20 is communicated to the output port 21 thereof, and at this time the vacuum which is stored in the vacuum accumulator tank 50 is communicated to the diaphragm chamber 17 of the diaphragm device 15, so as positively to bias this diaphragm 16 upwards in the drawing against the biasing action of the compression coil spring 18 which is overcome, and thereby the valve element 13 and the valve rod 14 which connects said valve element 13 to said diaphragm 16 are biased upwards in the drawing, so that the valve port 12 of the exhaust gas recirculation control valve 10 is opened to its maximum extent, thus allowing maximum exhaust gas recirculation through the exhaust gas recirculation conduit comprising the first and second conduit portions 9*a* and 9*b*, and this high level of exhaust gas recirculation effectively and immediately prevents dieseling run on operation within the combustion chambers of the internal combustion engine 1, and accordingly said internal combustion engine 1 stops as soon as the rotational energy of its rotating parts is dissipated by friction. Thus, in this application also, the annoying and troublesome phenomenon of run on is prevented.

Thus, it is seen that, according to the present invention, running on of the internal combustion engine due to the dieseling effect after the engine is switched off may be eliminated. Thus, there is no danger of undue vibration and unpleasant noise being produced during such running on, due to irregular and imperfect combustion of fuel in the engine. Also, the danger of overheating of a catalytic converter attached to the exhaust manifold of the engine, due to considerable quantities of unburnt gasoline being fed thereinto, and the danger of ignition of an accumulation of gasoline within the exhaust manifold or the exhaust pipe of the vechicle, which could lead to an explosion, are prevented. Further, according to the present invention, these benefits are attained without any large and bulky apparatus, such as for example was required for the prior art system of preventing running on by admitting a large amount of air by an air supply valve when the engine was switched off to the inlet manifold, and without providing any fuel cut off mechanism in the carburetor which operates in response to switching off of the ignition key of the vehicle, which is liable to deteriorate the normal functioning of the carburetor.

Although the present invention has been shown and described with reference to a preferred embodiment thereof, and in terms of the illustrative drawings, it should not be considered as limited thereby. Various possible modifications, omissions, and alterations could be conceived of by one skilled in the art to the form and the content of any particular embodiment, without departing from the scope of the present invention. Therefore it is desired that the scope of the present invention, and of the protection sought to be granted by Letters Patent, should be defined not by any of the perhaps purely fortuitous details of the shown embodiment, or of the drawings, but solely by the scope of the appended claims, which follow.

We claim:

1. For an internal combustion engine comprising:

an ignition system;

an exhaust system;

an intake system including an intake passage with a throttle valve mounted therein;

pipe means connecting said exhaust system with said intake system;

a vacuum operated flow control valve arranged on said pipe means and having a vacuum operating chamber which is normally connected to a first vacuum port formed in said intake passage at a position located slightly upstream of said throttle valve when closed in its idle position, said vacuum operated valve being opened by a vacuum signal transmitted to said chamber from said first vacuum port when the throttle valve is, during the operation of the engine, opened from said idle position so that the port is located downstream of said throttle valve, thereby causing a part of the gas from the exhaust system to be recirculated to the intake system via said pipe means;

a run on prevention system comprising:

a vacuum tank and a parallel connection of a one way valve and a throttling element, said vacuum tank receiving vacuum from said intake system through a second vacuum port formed in said intake passage at a position downstream of said throttle valve in its idle position, said vacuum tank receiving vacuum through both said one way valve and said throttling element while said internal combustion engine is running; and switching valve means which connect said vacuum operating chamber with said first port when said ignition system is supplied with actuating electrical power and which disconnects the connection of said vacuum operating chamber with said first port and connects said vacuum operating chamber with said vacuum tank when said ignition system is not supplied with actuating electrical power.

* * * * *